US008701362B2

(12) United States Patent
Stone

(10) Patent No.: US 8,701,362 B2
(45) Date of Patent: Apr. 22, 2014

(54) SKYLIGHT WITH THERMAL BREAK

(75) Inventor: Christopher J. Stone, Middletown, NJ (US)

(73) Assignee: Extech Building Materials, Newark, NJ (US)

( * ) Notice: Subject to any disclaimer, the term of this patent is extended or adjusted under 35 U.S.C. 154(b) by 124 days.

(21) Appl. No.: 13/351,520

(22) Filed: Jan. 17, 2012

(65) Prior Publication Data

US 2012/0255245 A1 Oct. 11, 2012

Related U.S. Application Data

(60) Provisional application No. 61/432,635, filed on Jan. 14, 2011.

(51) Int. Cl.
*E04B 7/18* (2006.01)

(52) U.S. Cl.
USPC ..... 52/200; 52/204.5; 52/204.53; 52/204.72

(58) Field of Classification Search
USPC ..... 52/72, 200, 204.5, 204.53, 204.71, 52/204.72, 309.1, DIG. 17
See application file for complete search history.

(56) References Cited

U.S. PATENT DOCUMENTS

| | | | | |
|---|---|---|---|---|
| 4,073,097 | A | 2/1978 | Jentoft et al. | |
| 4,117,638 | A | 10/1978 | Kidd, Jr. et al. | |
| 4,155,206 | A | 5/1979 | Player | |
| 4,514,943 | A | 5/1985 | Jentoft et al. | |
| 4,680,905 | A * | 7/1987 | Rockar | 52/200 |
| 4,750,302 | A | 6/1988 | Bechtold | |
| 6,164,025 | A | 12/2000 | Lindgren | |
| 6,279,290 | B1 * | 8/2001 | Richardson | 52/208 |
| 6,578,326 | B1 | 6/2003 | Dyrby et al. | |
| 2007/0011960 | A1 * | 1/2007 | Richardson | 52/200 |
| 2010/0146880 | A1 | 6/2010 | Valentz et al. | |

FOREIGN PATENT DOCUMENTS

| | | |
|---|---|---|
| CN | 201567705 U | 9/2010 |
| JP | 07-279328 A | 10/1995 |

* cited by examiner

*Primary Examiner* — Charles A Fox
*Assistant Examiner* — Patrick Maestri
(74) *Attorney, Agent, or Firm* — Gottlieb, Rackman & Reisman PC

(57) ABSTRACT

A skylight includes at least one glass section supported by an intermediate member. The intermediate member includes a beam supporting the glass section, a cap disposed above the glass section and an insulator disposed between and attaching the beam to the cap. The insulator forms a thermal break to impede heat transfer through the skylight in either direction.

14 Claims, 6 Drawing Sheets

SKYLIGHT WITH THERMAL BREAK

RELATED APPLICATION

This application claims priority to U.S. Provisional Application Ser. No. 61/432,635 filed on Jan. 14, 2011 and incorporated herein in its entirety.

BACKGROUND OF THE INVENTION

A. Field of Invention

This invention pertains to a skylight formed of one or more sheets of glass supported by a formed sheet metal frame and having a thermal break for insulation.

B. Description of the Prior Art

In recent years virtually all windows sold and installed in the US include a thermal break between the inner and outer components. The thermal break is formed using various well known insulating techniques. However, because of architectural and esthetic considerations, most skylights have different structures than windows, and these structures are normally not amenable to the same type of insulating techniques as the ones used for regular windows. This is commonly found, particularly with regard to the formed sheet metal skylights of the traditional style, often found on older and historic buildings.

It has been found that, because they are not properly thermally broken, skylights tend to conduct heat into a room during hot weather and have cold surfaces during cold weather. This latter problem is especially undesirable because it results in increased heating costs, and causes condensation that is esthetically unpleasing and may cause damage to the skylight and the surrounding area. Additionally, because many of the skylights of this fabrication style are found on older buildings, they are often fabricated of sheet copper, which is an excellent conductor of heat and energy, increasing the loss of valuable energy.

Thus, there is need for a skylight with a thermal break that is easy to install and inexpensive to build. Moreover, the skylight with a thermal break preferably has substantially the same dimensions so that it can be installed easily and efficiently without requiring special training. It is also critical that this skylight be capable of meeting the aesthetic concerns and needs of Historic and Landmarked buildings.

SUMMARY OF THE INVENTION

A skylight constructed in accordance with this invention includes at least one glass section having lateral edge, said glass section including at least one glass pane; and an intermediate member disposed along the lateral edge, said intermediate member being constructed and arranged to support said glass section, said intermediate member including a beam extending along and under said respective edge, said beam being formed with a vertical rib extending upwardly and being laterally spaced from said edge, an insulator disposed on said beam and extending upwardly adjacent to said edge and being attached along a lower portion to said rib, and a cap disposed on top of said lateral edge and being attached to said insulator, whereby said insulator forms a thermal break for said skylight.

The cap has a dome-shaped or V-shaped portion extending upwardly with the insulator extending into this portion. The beam is attached to the insulator typically with rivets or screws, bolts, etc., and the cap is preferably attached to the insulator by screws, bolts, copper strap or etc. In one embodiment, further insulation is provided underneath the cap.

In another aspect of the invention, a skylight constructed in accordance with this invention includes a first glass section formed of at least two glass panes extending in parallel to each other, said glass section having an edge with a spacer disposed along said edge between said glass panes;

a beam arranged to support said first glass section, said beam including a a rib extending upwardly and laterally spaced from said edge;

a cap disposed above said beam and resting on said glass section; and an insulator attached to said beam and said cap and providing thermal break therebetween.

The skylight may include a second glass section with said insulator being disposed between the glass sections. Alternatively, the skylight is provided with two or more glass sections, with respect intermediate members being provided between and at the ends of the glass sections.

DETAILED DESCRIPTION OF THE PREFERRED EMBODIMENT

Figure 1:
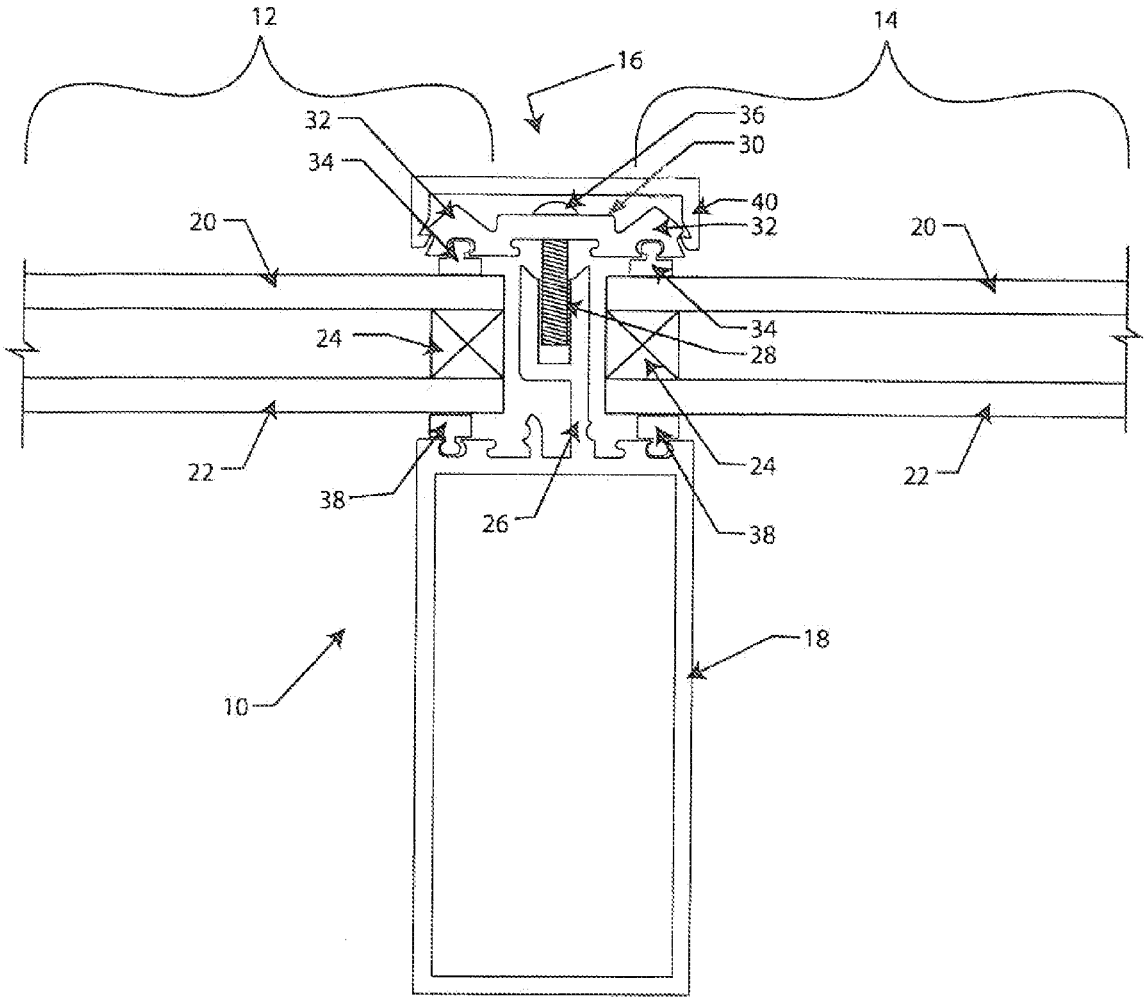
Fig. 1 PRIOR ART
FIG. 1 shows a cross-sectional view of a first type of conventional skylight.

FIG. 1 shows a conventional skylight 10 formed of two co-planar glass sections 12, 14 disposed adjacent to each other with an intermediate member 16. The intermediate member 16 is used to support the glass sections 12, 14 on a beam 18. Each glass section 12, 14, includes two glass panes (or glazing) 20, 22. At the edge of each section, the panes are separated by an insulating strip 24.

The intermediate member 16 includes a vertical rib 26 extending along the whole edges of the glass sections 12, 14. Rib 26 is formed with a continuous ribbed groove 28 to receive screws.

On top of the rib 26 there is a flat horizontal cover 30 having lateral downwardly extending walls 32 resting on weather stripping 34. The weather stripping 34 is resting on top of glass pane 20. The cover 30 is attached to the rib 26 by metal screws 36 spaced at regular intervals and engaging the ribbed slot 28. Weather stripping 38 is also provided between the glass panes 22 and the beam 18 as shown.

A protective cap 40 is disposed on top of cover 30.

The beam 18, rib 26, screw 36, cover 30 and cap 40 are all made of metal, e.g., aluminum or an alloy, and as a result, during warm weather heat is conducted from the outside to the inside through the elements just described. During winter, heat escapes through these same elements to the outside.

Figure 2:
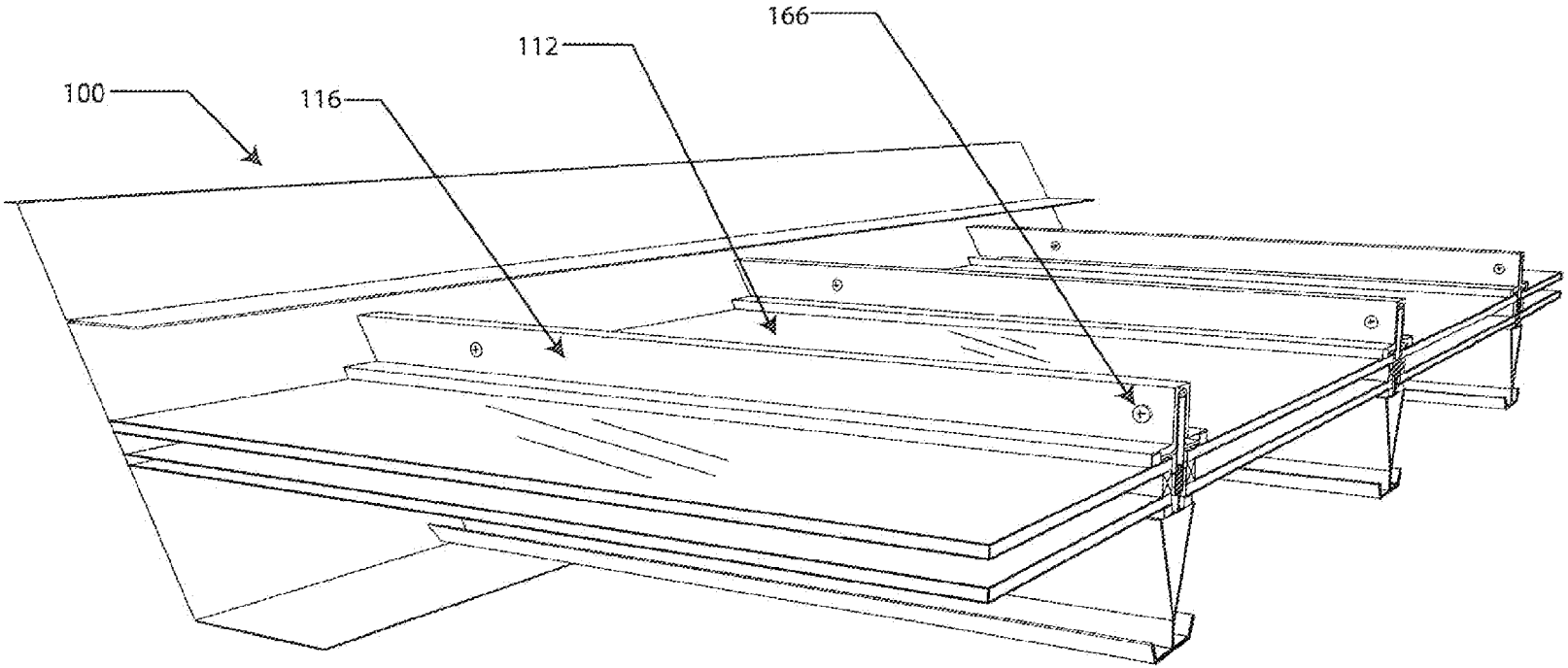
FIG. 2 shows an orthogonal view of a skylight constructed in accordance with this invention.
Figure 3:
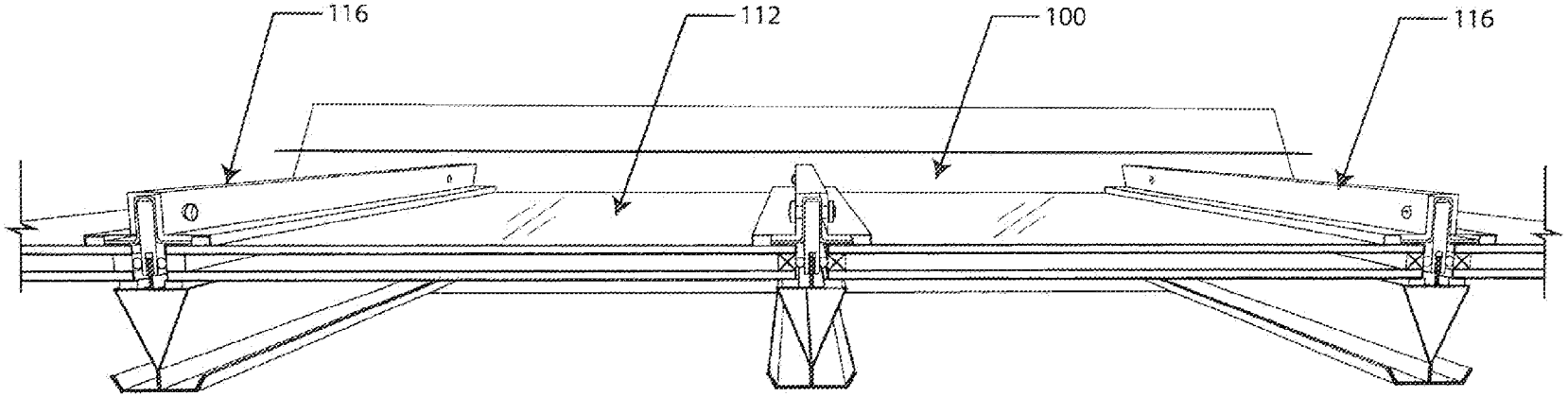
FIG. 3 shows a front cross-sectional view of the skylight of FIG. 2.
Figure 4:
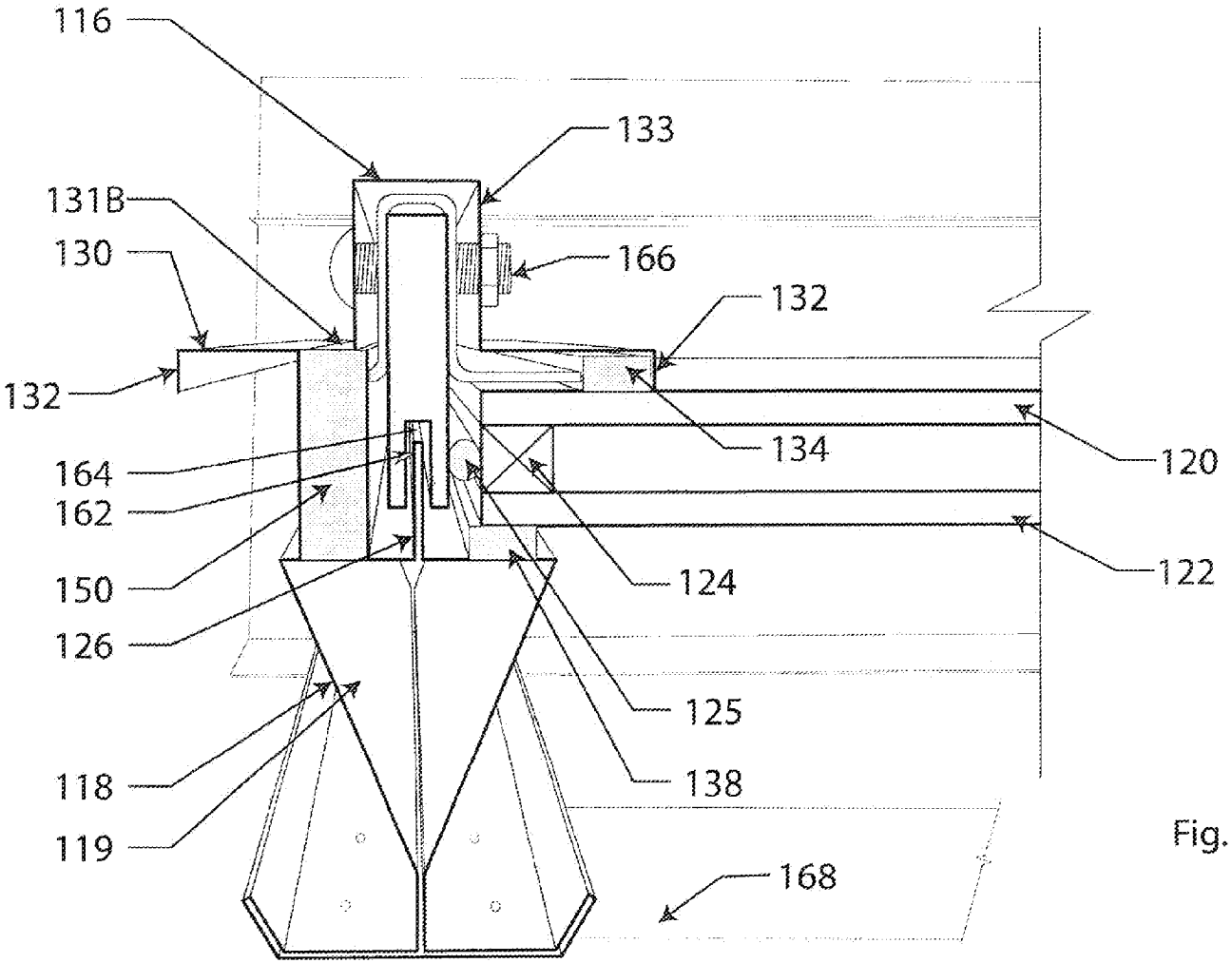
FIG. 4 shows an enlarged front view of the skylight of FIG. 2.

FIGS. 2-4 show a skylight constructed in accordance with this invention. In these figures, the skylight is depicted as having a single glass section (described more fully below)

supported at the two edges by respective intermediate members, it being understood that the skylight can have several glass sections.

More specifically, the skylight 100 includes a glass section 112 and intermediate sections 116. The glass section is formed of two glass panes 120,122 separated by a spacer 124. Weather strips 134, 138 are provided above pane 120 and below pane 122, respectively.

The intermediate member 116 includes a beam 118 with a rib 126 extending upwardly. In the Figures, the rib 126 is disposed between the glass section 112 and a spacer bar 150 made of wood or plastic. It should be understood that if the skylight has more than one glass sections, then the intermediate member 116 is disposed between two adjacent glass sections.

The beam 118 is preferably made of a flat sheet of metal, such as copper, galvanized steel, tin or alloys thereof. The sheet metal is then bent into the shape shown in the Figures so that it has a main, generally triangular section 119 with the rib 116 extending upwardly from the flat portion of section 119 and formed by overlapping portions of the sheet metal. The main section 119 can have other shapes as well.

Member 116 further includes a cap 130. The cap 130 is formed with two wings 131A, 131B terminating in respective lateral walls 132 extending downwardly, with the weather stripping 134 being disposed between a portion of the cap 130 and the glass pane 120. The cap 130 further includes a U-shaped portion 133 connecting the wings 131A, 131B. This U-shaped portion may also be sloped and resemble the top surfaces of a triangle.

A generally rectangular plastic insulator 160 is provided between the cap 130 and beam 118. The insulator 160 is preferably made of a high impact plastic material so that it can withstand considerably compressive forces. The insulator is formed with a longitudinal groove 162 sized and shaped to receive the rib 126. Insulator 160 has an upper portion that extends into the U-shaped or dome-shaped portion 133 of cap 130.

Preferably, the insulator 160 is attached to the rib 126 by rivets, screws or bolts 164 equally spaced along the length of the insulator 162.

Another set of screws or bolts 166 pass through the portion 133 of cap 130 and secure the cap 130 to the insulator 160. The cap may alternatively be secured in place by way of a copper strap of approximately 1" in width, riveted to insulator 160 and extending through a slot in the cap. This strap is fed through a corresponding slot in the cap 130, and bent down and sealed in place to secure the cap 130 in place.

To summarize, skylight 100 is formed of at least one glass section 112 and an intermediate member 116. The intermediate member 116 supports the skylight 100, for example on beam 168 and includes metallic members such as beam 118 and cap 130. The insulator 160 separates these two members and provides a thermal break between the outside of a structure, usually above the skylight and the inside of the structure, usually below the skylight.

Figure 5:
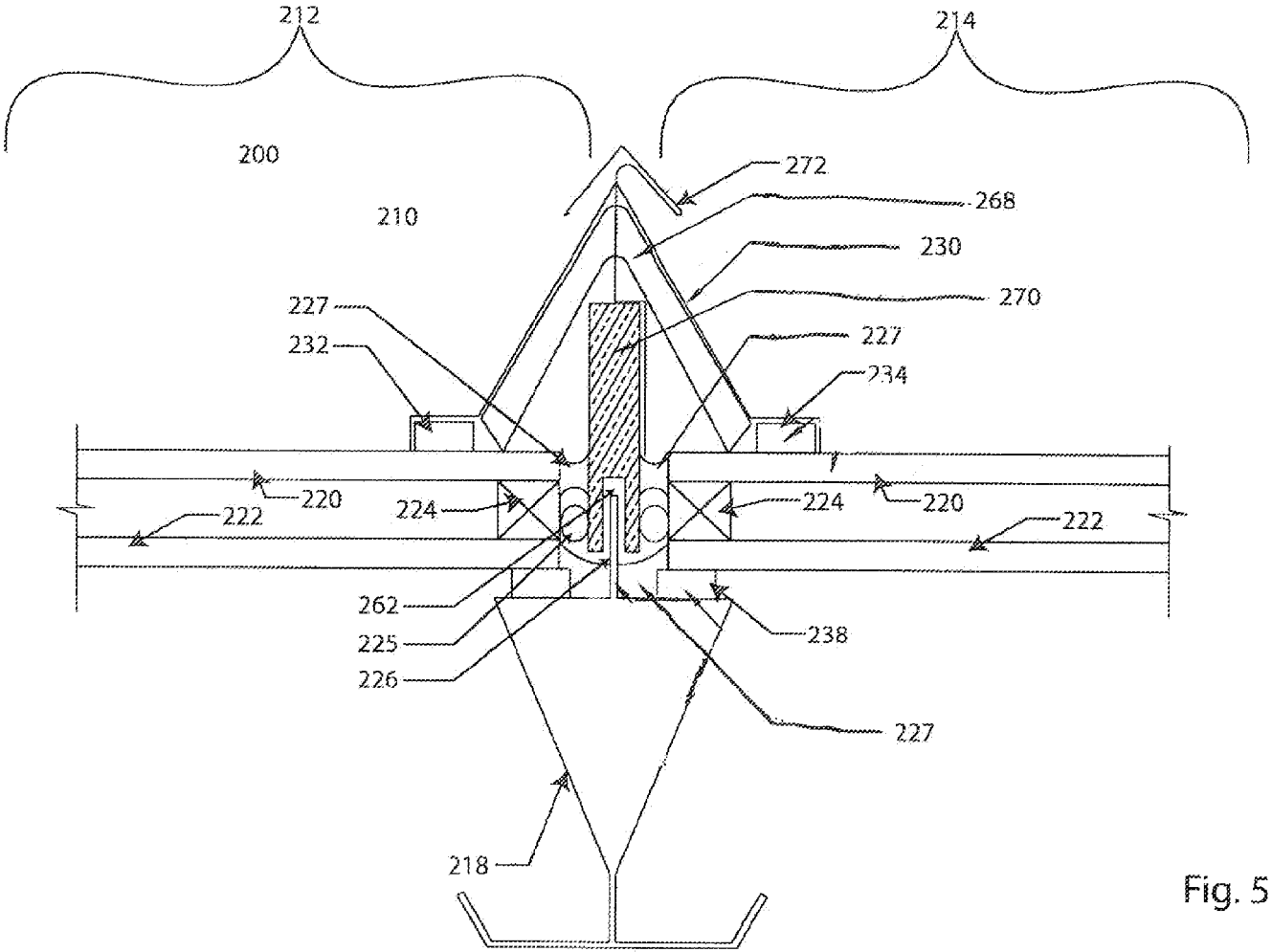
FIG. 5 shows a front cross-sectional view of an alternate embodiment.

FIGS. 5 and 6 show an alternate embodiment. In this embodiment, skylight 200 is also formed of two glass sections 212, 214 with an intermediate section 218. The intermediate section 218 includes a beam 219 with a rib stem 226.

The intermediate section 216 further includes an insulator 270 with a slot 262 receiving the rib stem 226. In this embodiment, the insulator 270 (260 in FIG. 6*a*) is attached to rib 226 by rivets 264.

The cap 230 in this embodiment has a v-shaped center body 230 terminating with downwardly extending walls 232. Under the center body, there is an inverted v-shaped secondary insulator 268 made of Styrofoam or similar material. Disposed along the edges of the glass panes there is at least on layer of sealant 227 to further provide insulation.

At several locations spaced longitudinally along cap 230, there are several straps 272. Has one end attached to the insulator 260 and a second end that passes through a respective hole in the cap (not shown) and is used to further maintain the cap 230 attached to the insulator 260 to retain cap and secondary insulation in place and provide initial water and UV barrier for sealants.

Figure 6B:
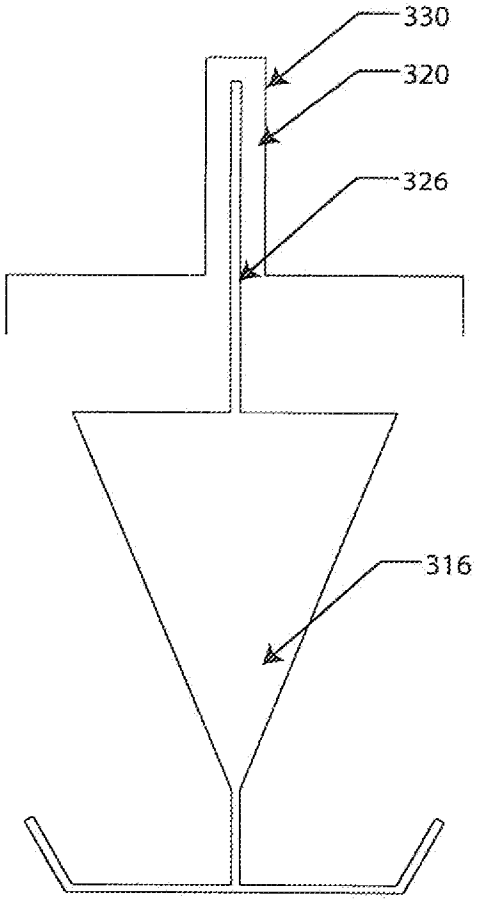
FIG. 6B shows an enlarged view of a second conventional skylight.
Figure 6A:
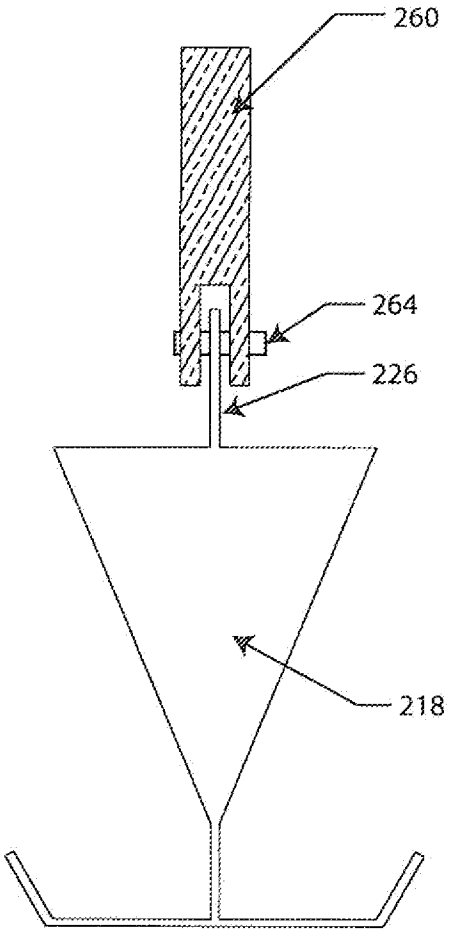
FIG. 6A shows an enlarged partial view of the embodiment of FIG. 5.

FIG. 6B shows parts of another conventional skylight. This skylight also has a intermediate member 316 with a rib 326. A V-shaped cap fits over the rib 326 and is attached to the rib directly using lateral screws, bolts, straps, or other well-known means. There is no insulation between the cap and the rib and therefore heat is transmitted through either in one direction or another.

Numerous modifications may be made to this invention without departing from its scope as defined in the appended claims.

I claim:

1. A skylight comprising:

at least one glass section having a lateral edge, said glass section including at least one glass pane; and an intermediate member disposed along said lateral edge, said intermediate member being constructed and arranged to support said glass section, said intermediate member including a beam extending along and under said edge, said beam being formed with a vertical rib extending upwardly and being laterally spaced from said edge, an insulator disposed on said beam and extending upwardly adjacent to said edge and being attached along a lower portion to said rib, and a cap disposed on top of said lateral edge and being attached to said insulator, wherein said insulator includes a slot opening downwardly with said rib extending into said slot whereby said insulator forms a thermal break for said skylight.

2. The skylight of claim 1 further comprising first and second glass sections with said intermediate member is disposed between the lateral edges of the glass panes.

3. The skylight of claim 1 further comprising weather stripping between the glass pane and said beam.

4. The skylight of claim 1 wherein said cap includes a dome shaped portion with said insulator extending into said dome-shaped portion.

5. The skylight of claim 1 further comprising attaching elements attaching said rib to said insulator.

6. The skylight of claim 1 further comprising attaching elements attaching said cap to said insulator.

7. The skylight of claim 1 wherein said cap has a V-shaped portion with said insulator extending into said V-shaped portion.

8. The skylight of claim 1 wherein said intermediate section further includes at least one strap extending upwardly through said cap.

9. A skylight comprising:

a first glass section formed of at least two glass panes extending in parallel to each other, said glass section having an edge with a spacer disposed along said edge between said glass panes;

a beam arranged to support said first glass section, said beam including a rib extending upwardly and laterally spaced from said edge; a cap disposed above said beam and resting on said glass section, wherein said cap and beam are made of metal and an insulator attached to said beam and supporting said cap and providing thermal break therebetween wherein said insulator includes a slot oriented downwardly and said rib extends into said slot.

10. The skylight of claim 9 further including a second glass section with said insulator being disposed between said glass sections.

11. The skylight of claim 9 further comprising attaching elements attaching said rib to said insulator.

12. The skylight of claim 9 further comprising attaching elements attaching said insulator to said cap.

13. The skylight of claim 9 further comprising insulating elements disposed between said cap and said glass section.

14. A skylight comprising:

at least one glass section having a lateral edge, said glass section including at least one glass pane; and an intermediate member disposed along said lateral edge, said intermediate member being constructed and arranged to support said glass section said intermediate member including a beam extending along and under said edge, said beam being formed with a vertical rib extending upwardly and being laterally spaced from said edge, an insulator disposed on said beam and extending upwardly adjacent to said edge and being attached along a lower portion to said rib, a cap disposed on top of said lateral edge and being attached to said insulator, and a strap extending upwardly through said cap, whereby said insulator forms a thermal break for said skylight.

* * * * *